US010804610B2

(12) United States Patent
Luk et al.

(10) Patent No.: US 10,804,610 B2
(45) Date of Patent: Oct. 13, 2020

(54) ANTENNA

(71) Applicant: City University of Hong Kong, Kowloon (HK)

(72) Inventors: Kwai Man Luk, Kowloon (HK); Yanhong Xu, Shaanxi (CN)

(73) Assignee: City University of Hong Kong, Kowloon (HK)

( * ) Notice: Subject to any disclaimer, the term of this patent is extended or adjusted under 35 U.S.C. 154(b) by 34 days.

(21) Appl. No.: 16/354,262

(22) Filed: Mar. 15, 2019

(65) Prior Publication Data

US 2020/0295461 A1 Sep. 17, 2020

(51) Int. Cl.

| | |
|---|---|
| ***H01Q 9/04*** | (2006.01) |
| ***H01Q 21/06*** | (2006.01) |
| ***H01Q 21/00*** | (2006.01) |
| ***H01Q 1/48*** | (2006.01) |
| ***H01Q 15/00*** | (2006.01) |

(52) U.S. Cl.

CPC ..... *H01Q 9/045* (2013.01); *H01Q 1/48* (2013.01); *H01Q 15/0093* (2013.01); *H01Q 21/0075* (2013.01); *H01Q 21/065* (2013.01)

(58) Field of Classification Search

None

See application file for complete search history.

(56) References Cited

U.S. PATENT DOCUMENTS

2006/0170604 A1* 8/2006 Almog ..... H01Q 1/38 343/795
2008/0252530 A1* 10/2008 Bae ..... H01Q 5/385 343/700 MS
2011/0298682 A1* 12/2011 Plet ..... H01Q 5/40 343/797

* cited by examiner

*Primary Examiner* — Jany Richardson

(74) *Attorney, Agent, or Firm* — Renner Kenner Greive Bobak Taylor & Weber

(57) ABSTRACT

An antenna with a substrate having a ground plane includes a fractal antenna arranged on the substrate to achieve aperture miniaturization. The fractal antenna has a first pair of patch antenna sections that are spaced apart. A first pair of electric conductive elements are spaced apart, extending in the substrate, and arranged generally orthogonal to the first pair of patch antenna sections. Each of the first pair of electric conductive elements is operably connected with a respective one of the first pair of patch antenna sections. A first feeding mechanism is operably connected with the first pair of patch antenna sections for feeding the first pair of patch antenna sections.

40 Claims, 17 Drawing Sheets

ANTENNA

TECHNICAL FIELD

The invention relates to an antenna and particularly, although not exclusively, to a compact wideband complementary antenna that can be used for wideband on-chip array applications.

BACKGROUND

The emergence of a new generation wireless communication technology impacts our daily lives and social activities, resulting in the continuous expansion of data traffic. Wideband antennas are particularly useful in these applications. Specifically, wideband complementary antenna, which generally includes an electric dipole and an orthogonally placed shorted patch antenna, can provide a relatively wide impedance bandwidth. At present, wideband complementary antenna has been employed for certain antenna applications (e.g., wideband antenna applications, millimeter-wave antenna applications, etc.) because of its excellent properties of stable gain and stable radiation pattern apart from the wide impedance bandwidth. Unfortunately, existing wideband complementary antennas tend to exhibit large antenna size, which make them undesirable for use in modern wireless systems as well as in certain array antenna applications (e.g., millimeter-wave array antenna applications).

SUMMARY OF THE INVENTION

It is an object of the invention to address the above needs, to overcome or substantially ameliorate the above disadvantages or, more generally, to provide an antenna that is efficient and compact, and is particularly adapted for millimeter-wave antenna array applications and massive multiple-input and multiple-output (MIMO) applications. The antenna can be a wideband complementary antenna, a millimeter-wave antenna, a microwave antenna, etc.

In accordance with a first aspect of the invention, there is provided an antenna, comprising: a substrate with a ground plane; a fractal antenna arranged on the substrate, the fractal antenna including a first pair of patch antenna sections that are spaced apart; a first pair of electric conductive elements, spaced apart, extending in the substrate, and arranged generally orthogonal to the first pair of patch antenna sections, each of the first pair of electric conductive elements being operably connected with a respective one of the first pair of patch antenna sections; and a first feeding mechanism operably connected with the first pair of patch antenna sections for feeding the first pair of patch antenna sections. The substrate can be made of any dielectric material. The electrically conductive elements, together with a portion of the ground plane between them, and at least part of the first feeding mechanism form a first shorted antenna. The shorted antenna together with one or more dipoles provided by the fractal antenna (complementary to the shorted antenna) are arranged to provide a linear polarization.

Preferably, the first pair of patch antenna sections each includes a via hole at a corner or side; and each of the first pair of electric conductive elements is operably connected with the via hole of the respective one of the first pair of patch antenna sections.

Preferably, the first pair of electric conductive elements are pins.

Preferably, the first pair of patch antenna sections are of the same size and same shape.

The first pair of patch antenna sections may both have: a Minkowski-based antenna structure; a Sierpinski Gasket-based antenna structure; or a Sierpinski Carpet-based antenna structure.

Preferably, the first pair of patch antenna sections have the same fractal orders, and more preferably, the fractal orders are second or higher fractal orders.

Preferably, the fractal antenna further includes a second pair of patch antenna sections that are spaced apart, and the antenna further includes a second pair of electric conductive elements that are spaced apart, extending in the substrate, and arranged generally orthogonal to the second pair of patch antenna sections, wherein each of the second pair of electric conductive elements is operably connected with a respective one of the second pair of patch antenna sections. The first feeding mechanism is further operably connected with the second pair of patch antenna sections for feeding the second pair of patch antenna sections.

Preferably, the first and second pair of patch antenna sections are equally angularly spaced apart with respect to a center of the fractal antenna.

Preferably, the second pair of patch antenna sections each includes a via hole at a corner or side; and each of the second pair of electric conductive elements is operably connected with the via hole of the respective one of the second pair of patch antenna sections.

Preferably, the second pair of electric conductive elements are pins.

The second pair of patch antenna sections may both have: a Minkowski-based antenna structure; a Sierpinski Gasket-based antenna structure; or a Sierpinski Carpet-based antenna structure.

Preferably, the second pair of patch antenna sections have the same fractal orders, and more preferably, the fractal orders are of second or higher fractal orders.

Preferably, the first and second pairs of patch antenna sections have the same fractal orders, the fractal orders being second or higher fractal orders.

Preferably, the antenna also includes a second feeding mechanism operably connected with the first and second pairs of patch antenna sections for feeding the first and second pairs of patch antenna sections.

Preferably, the fractal antenna has a symmetric configuration.

Preferably, the substrate comprises a first upper layer, a second middle layer, and a third lower layer; and the fractal antenna is arranged on the first upper layer.

In one embodiment of the first aspect, the ground plane is arranged between the second middle layer and the third lower layer. Preferably, the first feeding mechanism includes an L-probe feed. The L-probe feed of the first feeding mechanism may include: a first feeding patch arranged on the first upper layer in between the first pair of patch antenna sections and in between the second pair of patch antenna sections in plan view; a first microstrip line arranged in or below the third lower layer; and a first electrical conductor extending through the substrate and connecting with the first feeding element and the first microstrip line. Preferably, the first electrical conductor is a vertical pin or hole; and the ground plane has a cut-out such that the first electrical conductor extends through the ground plane without contacting the ground plane. Preferably, the first feeding patch and the first microstrip line are arranged parallel to each other. Preferably, the second feeding mechanism includes an L-probe feed. The L-probe feed of the second feeding mechanism may include: a second feeding patch arranged between the first upper layer and the second middle layer, and in between the first pair of patch antenna sections and in between the second pair of patch antenna sections in plan view; a second microstrip line arranged in or below the third lower layer; and a second electrical conductor extending through the second middle layer and the third lower layer of the substrate and connecting with the second feeding patch and the second microstrip line. Preferably, the second electrical conductor is a vertical pin or hole; and the ground plane has a cut-out such that the second electrical conductor extends through the ground plane without contacting the ground plane. Preferably, the second feeding patch and the second microstrip line are arranged parallel to each other. Preferably, the second feeding patch and the first feeding patch are arranged orthogonal to each other in plan view.

In another embodiment of the first aspect, the ground plane is arranged on a lower side of the third lower layer. Preferably, the first feeding mechanism includes an L-probe feed. The L-probe feed of the first feeding mechanism may include: a first feeding patch arranged on the first upper layer in between the first pair of patch antenna sections and in between the second pair of patch antenna sections in plan view; a first microstrip line arranged in or below the second middle layer; a first electrical conductor section extending through the first upper layer and the second middle layer to connect the first feeding patch and the first microstrip line; and a second electrical conductor section connecting with the first microstrip line and extending through the third lower layer and the ground plane. Preferably, the first electrical conductor section and the second electrical conductor section are vertical pins or holes; and wherein the ground plane has a cut-out such that the second electrical conductor section extends through the ground plane without contacting the ground plane. Preferably, the first electrical conductor section and the second electrical conductor section are offset in plan view. Preferably, the first feeding patch and the first microstrip line are arranged parallel to each other. Preferably, the second feeding mechanism includes an L-probe feed. The L-probe feed of the second feeding mechanism may include: a second feeding patch arranged between the first upper layer and the second middle layer, and in between the first pair of patch antenna sections and in between the second pair of patch antenna sections in plan view; a second microstrip line arranged in or below the second middle layer; a third electrical conductor section extending at least through the second middle layer to connect the second feeding patch and the second microstrip line; and a fourth electrical conductor section connecting with the second microstrip line and extending through the third lower layer and the ground plane. Preferably, the third electrical conductor section and the fourth electrical conductor section are vertical pins or holes; and the ground plane has a cut-out such that the fourth electrical conductor section extends through the ground plane without contacting the ground plane. Preferably, the third electrical conductor section and the fourth electrical conductor section are offset in plan view. Preferably, the second feeding patch and the second microstrip line are arranged parallel to each other. Preferably, the first feeding patch and the second feeding patch are arranged orthogonal to each other in plan view.

In accordance with a second aspect of the invention, there is provided an antenna array comprising the antenna of the first aspect. The antenna array may be used in millimeter-wave communication system.

In accordance with a third aspect of the invention, there is provided an electrical communication device comprising the antenna of the first aspect or the antenna array of the second aspect. The electrical communication device may be a computer, a smart phone, a smart watch, a smart wearable device, or any other communication devices.

In accordance with a fourth aspect of the invention, there is provided an antenna comprising: a substrate with a ground plane; a first dipole portion and a second dipole portion arranged on the substrate; a first L-probe feed; and a set of electrically conductive pins or holes operably connected with the first and second dipole portions.

Preferably, the antenna further includes a second L-probe feed.

In one embodiment of the fourth aspect, the first dipole portion includes a first fractal patch antenna section, preferably with a via hole. The first fractal patch antenna section may have a Minkowski-based antenna structure; a Sierpinski Gasket-based antenna structure; or a Sierpinski Carpet-based antenna structure. The first fractal patch antenna section may have any fractal order, preferably second or higher fractal order.

In one embodiment of the fourth aspect, the first dipole portion further includes a second fractal patch antenna section, preferably with a via hole. The second fractal patch antenna section may have a Minkowski-based antenna structure; a Sierpinski Gasket-based antenna structure; or a Sierpinski Carpet-based antenna structure. The second fractal patch antenna section may have any fractal order, preferably second or higher fractal order.

In one embodiment of the fourth aspect, the second dipole portion includes a third fractal patch antenna section, preferably with a via hole. The third fractal patch antenna section may have a Minkowski-based antenna structure; a Sierpinski Gasket-based antenna structure; or a Sierpinski Carpet-based antenna structure. The third fractal patch antenna section may have any fractal order, preferably second or higher fractal order.

In one embodiment of the fourth aspect, the second dipole portion further includes a fourth fractal patch antenna section, preferably with a via hole. The fourth fractal patch antenna section may have a Minkowski-based antenna structure; a Sierpinski Gasket-based antenna structure; or a Sierpinski Carpet-based antenna structure. The fourth fractal patch antenna section may have any fractal order, preferably second or higher fractal order.

Preferably, the first L-probe feed includes a first microstrip line, a first electrically conductive pin or hole, and a first rectangular patch.

Preferably, the first microstrip line is arranged parallel to the first dipole portion and/or the second dipole portion.

Preferably, the first microstrip line has one end connected to the first electrically conductive pin or hole.

Preferably, the first electrically conductive pin or hole is arranged perpendicular to the first microstrip line.

Preferably, the first electrically conductive pin or holes has one end connected with the first microstrip line and the other end connected with the first rectangular patch.

Preferably, the first rectangular patch is located between the first dipole portion and the second dipole portion.

Preferably, the first rectangular patch has one end connected to the first electrically conductive pin or hole.

Preferably, the second L-probe feed includes a second microstrip line, a second electrically conductive pin or hole, and a second rectangular patch.

Preferably, the second microstrip line is arranged parallel to the first dipole portion and/or the second dipole portion.

Preferably, the second microstrip line is orthogonally placed to the first microstrip line in the same plane without contacting the first microstrip line.

Preferably, the second microstrip line has one end connected to the second electrically conductive pin or hole.

Preferably, the second electrically conductive pin or hole is arranged perpendicular to the second microstrip line.

Preferably, the second electrically conductive pin or hole has one end connected to the second microstrip line and another end connected to the second rectangular patch.

Preferably, the second rectangular patch is orthogonal to the first rectangular patch in plan view.

Preferably, the second rectangular patch is not in the same plane with the first rectangular patch.

Preferably, the set of electrically conductive pins or holes comprises one or more of: a third electrically conductive pin or hole connected to the first fractal patch antenna section, a fourth electrically conductive pin or hole connected to the second fractal patch antenna section, a fifth electrically conductive pin or hole connected to the third fractal patch antenna section, and a sixth electrically conductive pin or hole connected to the fourth fractal patch antenna section.

In one embodiment of the fourth aspect, the substrate comprises three layers: an upper layer, a middle layer, and a lower layer. The middle layer may be thicker than the other two layers.

Preferably, one or more or all of the first dipole portion, the second dipole portion and the first rectangular patch are formed on (e.g., printed on) the upper surface of the upper layer.

Preferably, the second rectangular patch is formed on (e.g., printed on) the upper surface of the middle layer.

In one embodiment of the fourth aspect, a ground plane can be formed on (e.g., printed on) the lower surface of the middle substrate. Preferably, the first microstrip line and the second microstrip line can be formed on (e.g., printed on) the lower surface of the lower layer. Preferably, the first electrically conductive pin or hole extends through all three layers of the substrate. Preferably, the second electrically conductive pin or hole extends through the middle and lower layers. Preferably, the third electrically conductive pin or hole extends through all three layers of the substrate. Preferably, the fourth electrically conductive pin or hole extends through all three layers of the substrate. Preferably, the fifth electrically conductive pin or hole extends through all three layers of the substrate. Preferably, the sixth electrically conductive pin or hole extends through all three layers of the substrate.

In one embodiment of the fourth aspect, a ground plane can be formed on (e.g., printed on) the lower surface of the lower substrate. Preferably, the first microstrip line and the second microstrip line can be formed on (e.g., printed on) the lower surface of the middle layer or the upper surface of the lower layer. Preferably, the first electrically conductive pin or hole extends through the upper and middle layers. Preferably, the second electrically conductive pin or hole extends through the middle layer. Preferably, the third electrically conductive pin or hole extends through all three layers of the substrate. Preferably, the fourth electrically conductive pin or hole extends through all three layers of the substrate. Preferably, the fifth electrically conductive pin or hole extends through all three layers of the substrate. Preferably, the sixth electrically conductive pin or hole extends through all three layers of the substrate.

In accordance with a fifth aspect of the invention, there is provided an antenna array comprising the antenna of the fourth aspect. The antenna array may be used in millimeter-wave communication system.

In accordance with a sixth aspect of the invention, there is provided an electrical communication device comprising the antenna of the fourth aspect or the antenna array of the fifth aspect. The electrical communication device may be a computer, a smart phone, a smart watch, a smart wearable device, or any other communication devices.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

Figure 1:
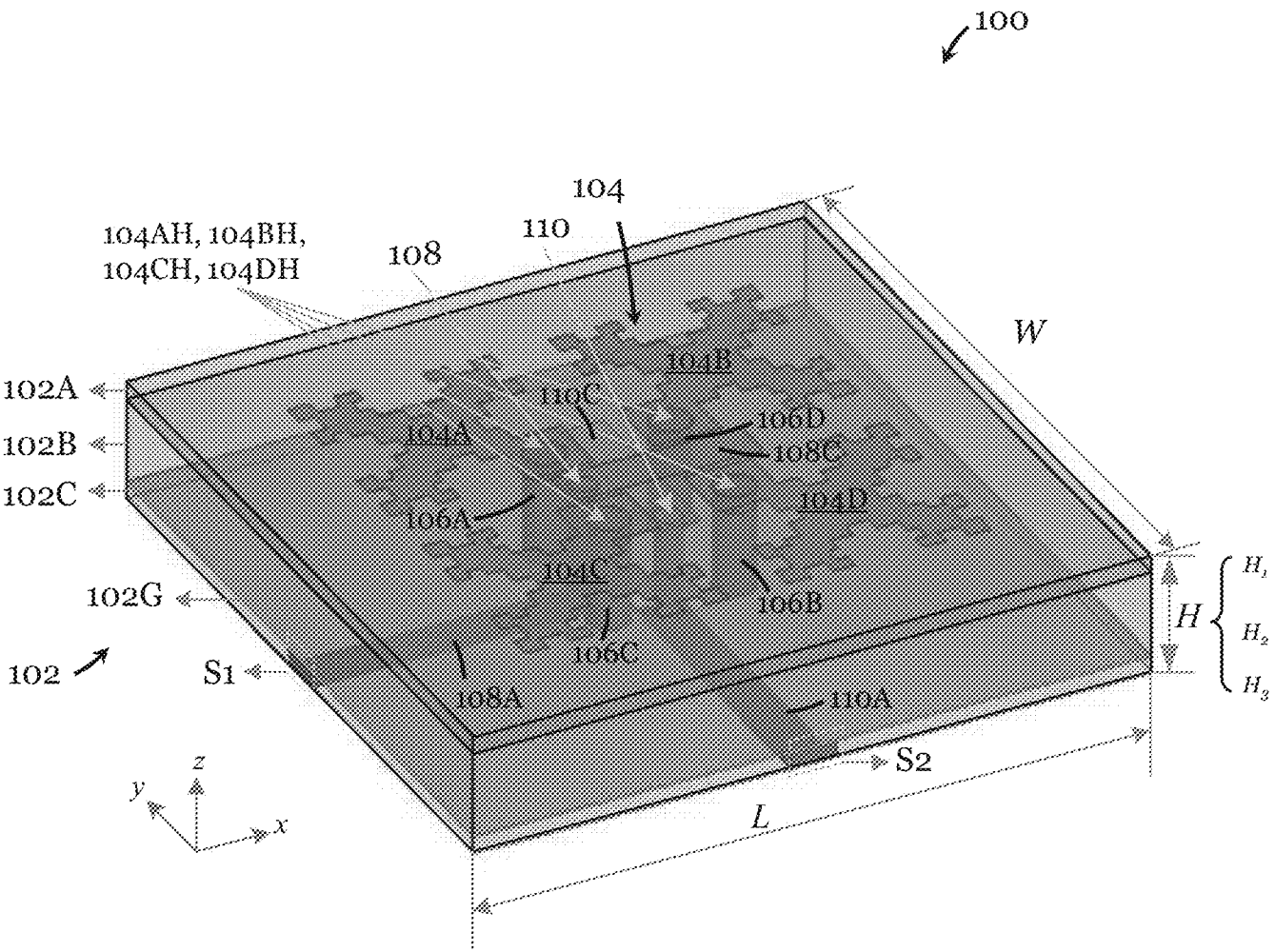
FIG. 1 is a wideband complementary antenna in one embodiment of the invention.
Figure 2C:
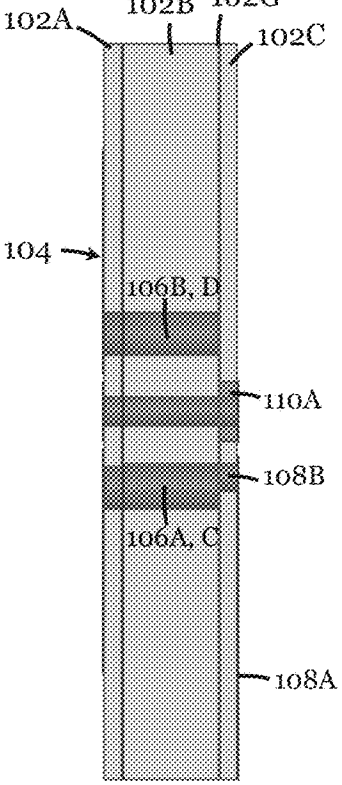
FIG. 2C is another side view of the wideband complementary antenna of FIG. 1.
Figure 2A:
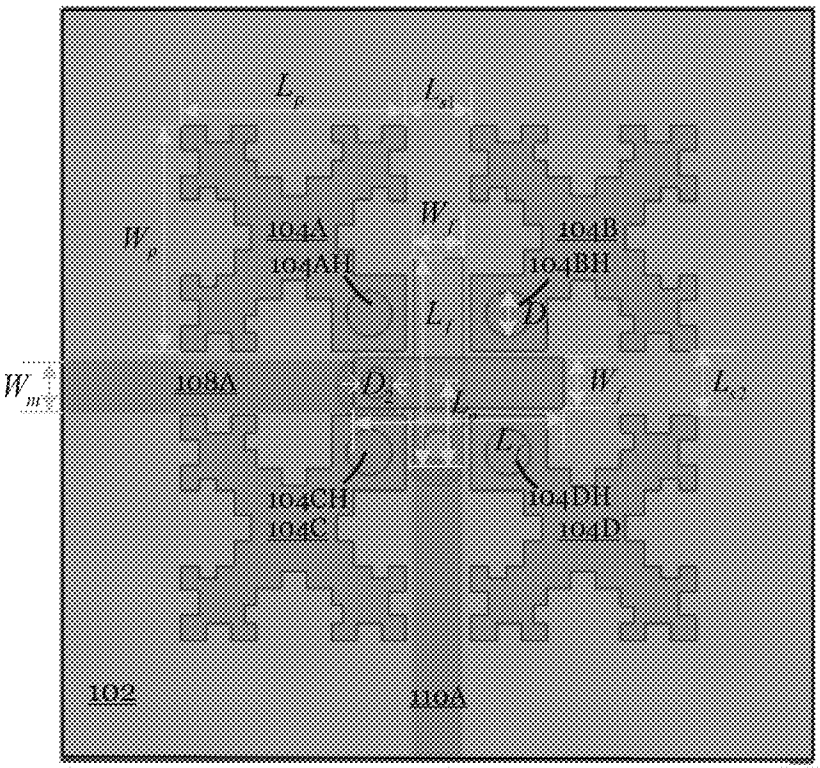
FIG. 2A is a plan (top) view of the wideband complementary antenna of FIG. 1.
Figure 2B:
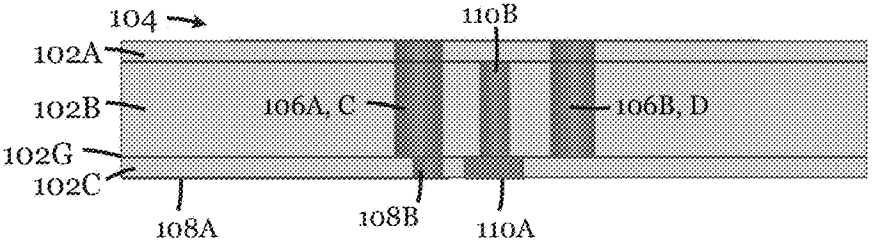
FIG. 2B is a side view of the wideband complementary antenna of FIG. 1.

FIGS. 1 to 2C show a wideband complementary antenna too in one embodiment of the invention. The antenna 100 includes a substrate 102 with a ground plane 102G. The substrate 102 is made of dielectric material and has three layers: an upper layer 102A of the first substrate, a middle layer 102B of the second substrate, and a lower layer 102C of the third substrate. The first, second, and third substrates may be the same or different. In this embodiment, the upper and lower layers 102A, 102C have same or similar thickness, and the middle layer 102B is thicker than each of the upper and lower layers 102A, 102C. A ground plane 102G is arranged between the middle and lower layers 102B, 102C (the ground plane 102G can be as part of the middle layer 102B or part of the lower layer 102C).

The antenna too also includes a fractal antenna 104 formed by a first patch antenna section 104A, a second patch antenna section 104B, a third patch antenna section 104C, and a fourth patch antenna section 104D. As best shown in FIG. 2A, the fractal antenna 104 formed by the four antenna sections 104A-104D has multiple axes of symmetry. The four patch antenna sections 104A-104D can be made of metal. The four patch antenna sections 104A-104D are spaced apart from each other without direct contact. The fractal antenna 104 is arranged on the top surface of the upper layer 102A. In this embodiment, the four patch antenna sections 104A-104D are of the same shape and form. The first and second patch antenna sections 104A, 104B may provide a first dipole portion (e.g., a first electric dipole). The third and fourth patch antenna sections 104C, 104D may provide a second dipole portion (e.g., a second electric dipole). The first and third patch antenna sections 104A, 104C may provide a third dipole portion (e.g., a third electric dipole). The second and fourth patch antenna sections 104B, 104D may provide a fourth dipole portion (e.g., a fourth electric dipole). In this embodiment, each of the patch antenna sections 104A-104D has a Minkowski-based structure. Specifically, the corner part of the antenna section closest to a center of the fractal antenna 104 has a first order Minkowski structure, as well as a via hole 104AH, 104BH, 104CH, 104DH formed in the structure. The other three corner parts of the antenna section each has a second order Minkowski structure. The via holes 104AH, 104BH, 104CH, 104DH of the four patch antenna sections 104A, 104B, 104C, 104D are close to each other adjacent the center of the fractal antenna 104.

Each of the via holes 104AH, 104BH, 104CH, 104DH of the patch antenna section 104A, 104B, 104C, 104D is connected with a respective electrically conductive element 106A, 106B, 106C, 106D, which in this embodiment is a pin extending through the upper and middle layers 102A-102B of the substrate 102. Specifically, an electrically conductive pin 106A is connected to the first patch antenna section 104A. Another electrically conductive pin 106B is connected to the second patch antenna section 104B. Another electrically conductive pin 106C is connected to the third patch antenna section 104C. Another electrically conductive pin 106D is connected to the fourth patch antenna section 104D. These electrically conductive elements 106A, 106B, 106C, 106D can be alternatively implemented as a set of vias or holes.

The antenna also includes a first L-probe feed 108 and a second L-probe feed 110 operably connected with the fractal antenna. The first L-probe feed 108 and the second L-probe feed 110 are of like construction but different orientation.

The first L-probe feed 108 includes a planar microstrip line 108A arranged on the bottom side of the lower layer 102C of the substrate 102, a vertical electrical conductor 108B extending through all three layers 102A-102C of the substrate 102, and a rectangular patch 108C arranged on an upper side of the upper layer 102A of the substrate 102. The microstrip line 108A extends horizontally, parallel to the base plane of the lower layer 102C of the substrate 102. The microstrip line 108A has one end S1 arranged for coupling with a signal source, e.g., a launcher, mounted on one side, and another end connected with the vertical electrical conductor 108B. The vertical electrical conductor 108B has one end connected with the microstrip line 108A and another end connected with the patch 108C. The ground plane 102G includes a cut-out through which the electrical conductor 108B extends without contacting the ground plane 102G. The patch 108C extends horizontally, parallel to the upper plane of the upper layer of the substrate. The patch 108C and the microstrip line 108A elongates along the same direction (x-direction). The patch 108C and the microstrip line 108A extend towards opposite sides with respect to the vertical electrical conductor 108B in plan view. The vertical electrical conductor 108B can be a pin or a hole. The first L-probe feed 108 can be coupled to the first and second dipole portions.

The second L-probe feed 110 includes a planar microstrip line 110A arranged on the bottom side of the lower layer 102C of the substrate 102, a vertical electrical conductor 110B extending through the middle and lower layers 102B, 102C of the substrate 102, and a rectangular patch 110C arranged on an lower side of the upper layer 102A of the substrate 102 (or an upper side of the middle layer 102B of the substrate 102). The microstrip line 110A extends horizontally, parallel to the base plane of the lower layer 102C of the substrate 102, and orthogonal to the microstrip line 108A of the first L-probe feed 108, without contacting the microstrip line 108A of the first L-probe feed 108. The microstrip line 110A has one end arranged for coupling with a signal source S2, e.g., a launcher, mounted on one side, and another end connected with the vertical electrical conductor 110B. The vertical electrical conductor 110B has one end connected with the microstrip line 110A and another end connected with the patch 110C. The ground plane 102G includes a cut-out through which the electrical conductor 110B extends without contacting the ground plane 102G. The patch 110C extends horizontally, parallel to the lower plane of the upper layer 102A of the substrate 102, and orthogonal to the patch 108C of the first L-probe feed 108 in plan view. The patch 110C and the microstrip line 110A of the second L-probe feed 110 elongates along the same direction (y-direction), orthogonal to the patch 108C and the microstrip line 108A of the first L-probe feed 108. The patch 110C and the microstrip line 110A extend towards opposite sides with respect to the vertical electrical conductor 110B in plan view. The vertical electrical conductor 110B can be a pin or a hole. The second L-probe 110 can be coupled to the third and fourth dipole portions. The orientation of the microstrip lines 108A, 110A allow the two excitation ports S2 and S2 to be sufficiently separated from each other to achieve dual linear polarization.

Figure 3A:
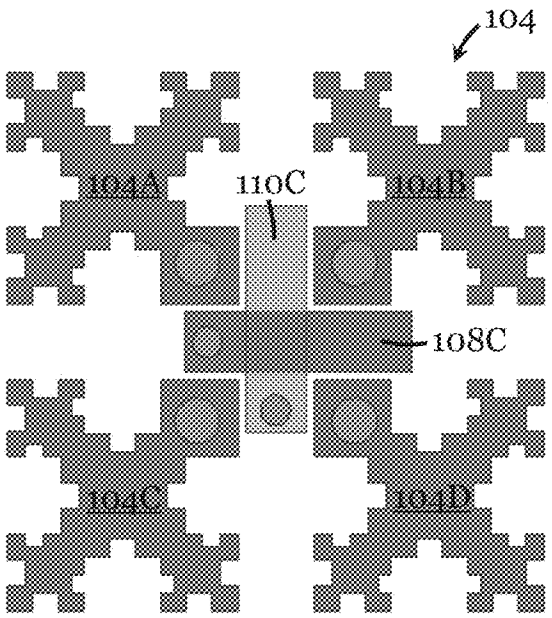
FIG. 3A is a schematic diagram of a fractal antenna of the wideband complementary antenna of FIG. 1 with four patch antenna sections (also showing the feeding patches)
Figure 3B:
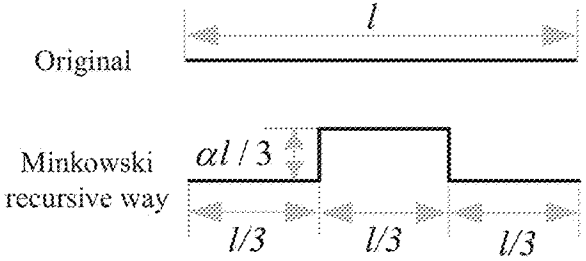
FIG. 3B is a graph illustrating the parameters relating to the Minkowski-based antenna structure of FIG. 3A.

In the present embodiment, the four electrically conductive elements 106A, 106B, 106C and 106D, together with the portion of the ground plane 102G between them, and the vertical electrical conductor 108B and the rectangular patch 108C of the first L-probe feed 108, form a first shorted antenna. The first shorted antenna together with the first electric dipole (provided by the first and second antenna sections 104A, 104B) and second electric dipole (provided by the third and fourth antenna sections 104C, 104D) complementary to the first shorted antenna form a complementary antenna that can provide a linear polarization (x-polarization). The four electrically conductive elements 106A, 106B, 106C and 106D, together with the portion of the ground plane 102G between them, and the vertical electrical conductor 110B and the rectangular patch 110C of the second L-probe feed 110, form a second shorted antenna. The second shorted antenna together with the third electric dipole (provided by the first and third antenna sections 104A, 104C) and fourth electric dipole (provided by the second and fourth antenna sections 104B, 104D) complementary to the second shorted antenna form a complementary antenna that can provide another linear polarization (y-polarization). FIG. 3A shows the fractal antenna 104 of the wideband complementary antenna 100 of FIG. 1 with four patch antenna sections along with the feeding patches 108C, 110C. FIG. 3B illustrates the basic fractal mechanism relating to the Minkowski-based antenna structure. In some embodiments, the fractal scale factor $\alpha$ is preferably in the range of 0.5 to 0.8.

Figure 3C:
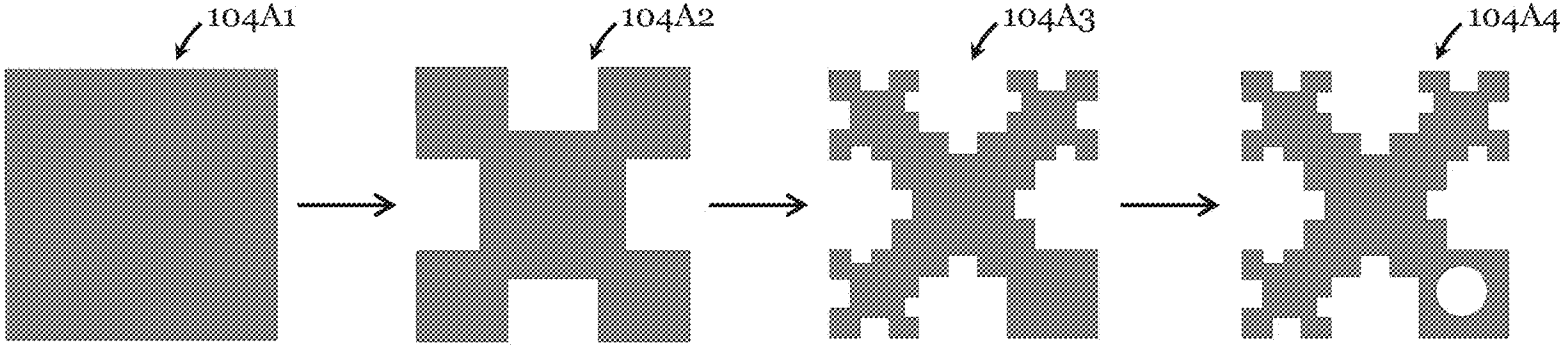
FIG. 3C is a schematic flow diagram illustrating the formation of the Minkowski-based antenna structure of the patch antenna sections in FIG. 3A.

FIG. 3C illustrates the formation of the Minkowski-based antenna structure of the patch antenna section 104A in FIG. 3A. Initially, the four sides of a rectangular patch 104A1 are replaced with the corresponding Minkowski recursive curves of a first order Minkowski structure. Then the resulting patch 104A2, except for its bottom right corner portion, is then further modified with corresponding Minkowski recursive curves of a second order Minkowski structure. The bottom right corner portion remains with a first order Minkowski structure, as illustrated in structure 104A3. A via hole is drilled or other formed in this first order Minkowski structure, resulting in the structure 104A4. The resulting patch 104A4 is the patch antenna section 104A on the top left corner portion of the fractal antenna 104 in FIG. 3A.

In the exemplary antenna shown in FIG. 3A, each patch antenna section is a Minkowski-like fractal structure having a width $W_p$ and length $L_p$. $W_p$ and length $L_p$ are all approximately equal to $0.26\lambda_3$ (where $\lambda_g$ is the intended operating dielectric wavelength at center frequency of 33 GHz). The spacing between each two adjacent dipole sections is approximately equal to $0.067\lambda_g$. Therefore, the aperture size $(2\times L_p+L_{S1})\times(2\times W_p+L_{S2})$ of the exemplary antenna shown in FIG. 1 is $0.397\lambda_o\times\mathbf{0.397}\lambda_o$, which is much smaller than typical wideband complementary antenna. The height of the antenna substrate $H_1+H_2+H_3$ is approximately $0.207\lambda_g$. Besides, the substrate is Rogers RT 5880 with dielectric permittivity of $\epsilon_r=2.2$, and loss tangent $\tan\delta=0.0009$.

The exemplary antenna shown in FIGS. 1-2C can be employed for antenna applications at various frequencies, such as but not limited to, a 28 GHz band, a 38 GHz band, a 60 GHz band, etc.

Table I below defines typical dimensions (in mm and as wavelength fractions) of geometrical parameters (e.g. W, L, $H_1$, $H_2$, $H_3$, $W_p$, $L_p$, $W_f$, $L_f$, $L_{S1}$, $L_{S2}$, $L_o$, $D_1$, $D_2$, $W_m$, and $\alpha$) associated with the exemplary antenna in FIGS. 1-3C (best illustrated in FIG. 2A) when operated at a center frequency of 33 GHz.

TABLE I

| | Parameters | | | | | | | |
|---|---|---|---|---|---|---|---|---|
| | W | L | $H_1$ | $H_2$ | $H_3$ | $W_p$ | $L_p$ | $W_f$ |
| Value | 10 mm | 10 mm | 0.127 mm | 1.016 mm | 0.127 mm | 1.6 mm | 1.6 mm | 0.35 mm |
| In free space wavelength | 1.1 $\lambda_o$ | 1.1 $\lambda_o$ | 0.014 $\lambda_o$ | 0.112 $\lambda_o$ | 0.014 $\lambda_o$ | 0.176 $\lambda_o$ | 0.176 $\lambda_o$ | 0.038 $\lambda_o$ |
| In dielectric wavelength | — | — | 0.021 $\lambda_g$ | 0.165 $\lambda_g$ | 0.021$\lambda_g$ | 0.26 $\lambda_g$ | 0.26 $\lambda_g$ | 0.056 $\lambda_g$ |

TABLE I-continued

| | Parameters | | | | | | | |
|---|---|---|---|---|---|---|---|---|
| | $L_f$ | $L_{s1}$ | $L_{s2}$ | $L_o$ | $D_1$ | $D_2$ | $W_m$ | $\alpha$ |
| Value | 1.4 mm | 0.41 mm | 0.41 mm | 0.4 mm | 0.3 mm | 0.25 mm | 0.35 mm | 0.7 |
| In free space wavelength | 0.154 $\lambda_o$ | 0.045 $\lambda_o$ | 0.045 $\lambda_o$ | 0.044 $\lambda_o$ | 0.033 $\lambda_o$ | 0.027 $\lambda_o$ | 0.038 $\lambda_o$ | — |
| In dielectric wavelength | 0.227 $\lambda_g$ | 0.067 $\lambda_g$ | 0.067 $\lambda_g$ | 0.065 $\lambda_g$ | 0.049 $\lambda_g$ | 0.04 $\lambda_g$ | 0.056 $\lambda_g$ | — |

Figure 4:
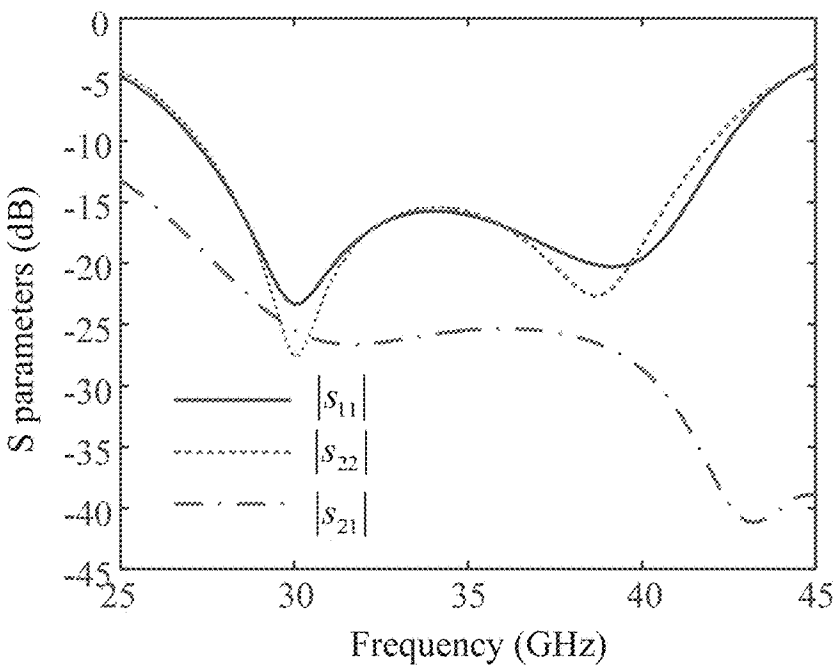
FIG. 4 is a graph showing the simulated S-parameters ($S_{11}$, $S_{22}$, $S_{21}$) with respect to frequency (GHz) for the wideband complementary antenna of FIG. 1.

FIG. 4 shows the simulated S-parameters with respect to frequency for the antenna embodiment of FIG. 1. It can be seen from FIG. 4 that the wide impedance bandwidth characteristic of complementary antenna is maintained:

44% (with $S_{11}$ less than −10 dB from 27.15 GHz to 42.45 GHz) for x-polarization 43% (with $S_{22}$ less than −10 dB from 27.25 GHz to 42.15 GHz) for y-polarization 35.8% overlapped bandwidth (with both $S_{11}$ and $S_{22}$ less than −15 dB from 28.4 GHz to 40.8 GHz).

The isolation level between the two ports is less than −18 dB within the operational frequency region.

Figure 5:
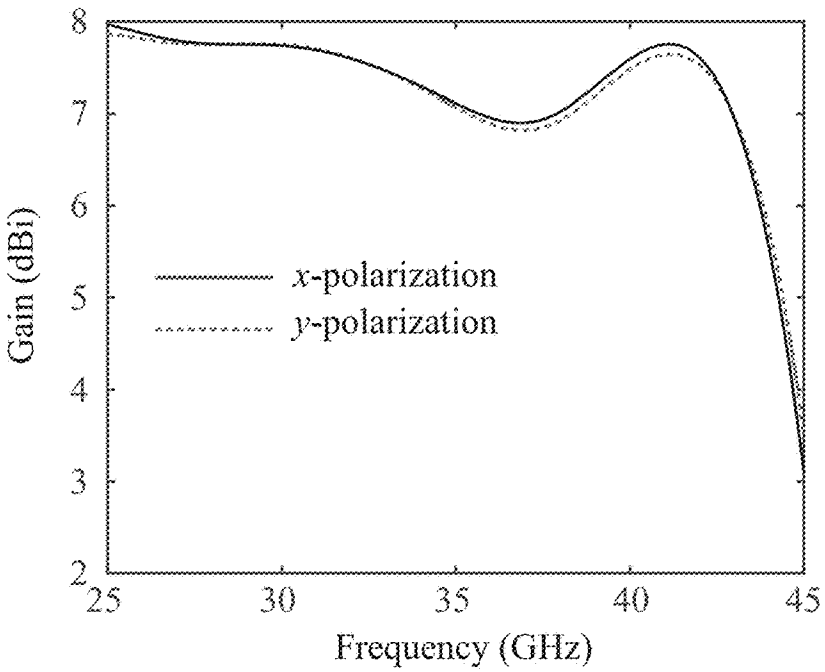
FIG. 5 is a graph showing the simulated gains (x- and y-polarizations) with respect to frequency (GHz) for the wideband complementary antenna of FIG. 1.

FIG. 5 illustrates the simulated gains with respect to frequency for the antenna embodiment of FIG. 1. An average gain of 7.35 dBi varying from 6.9 dBi to 7.8 dBi can be observed within the operational frequency region. As the aperture ( ) size is miniaturized, the gain is slightly smaller than 8 dBi.

Figure 6A:
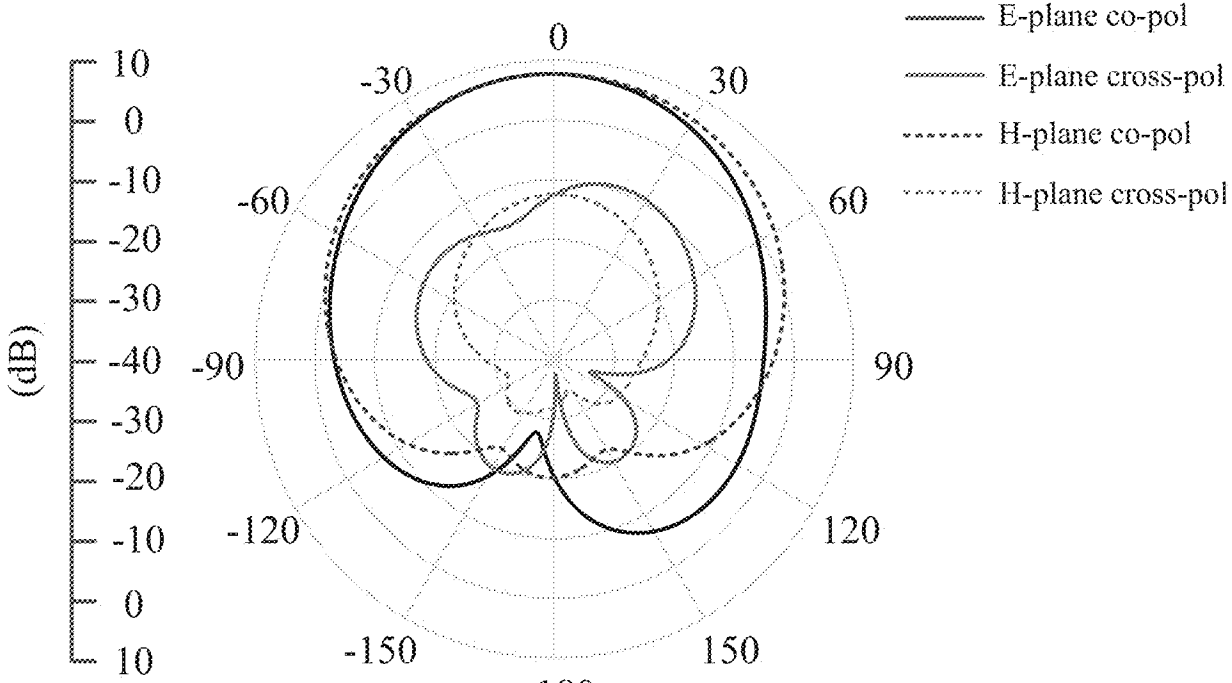
FIG. 6A is a simulated radiation pattern (x-polarization) of the wideband complementary antenna of FIG. 1 at 28 GHz.
Figure 6B:
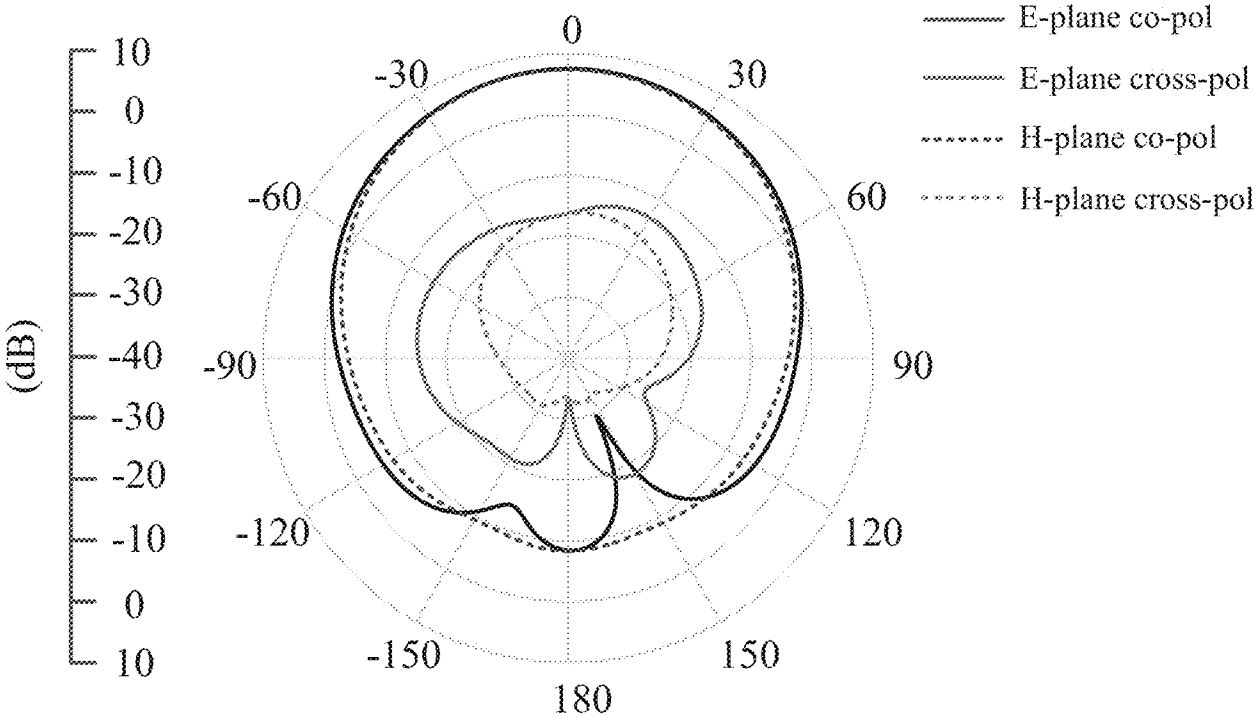
FIG. 6B is a simulated radiation pattern (x-polarization) of the wideband complementary antenna of FIG. 1 at 33 GHz.
Figure 6C:
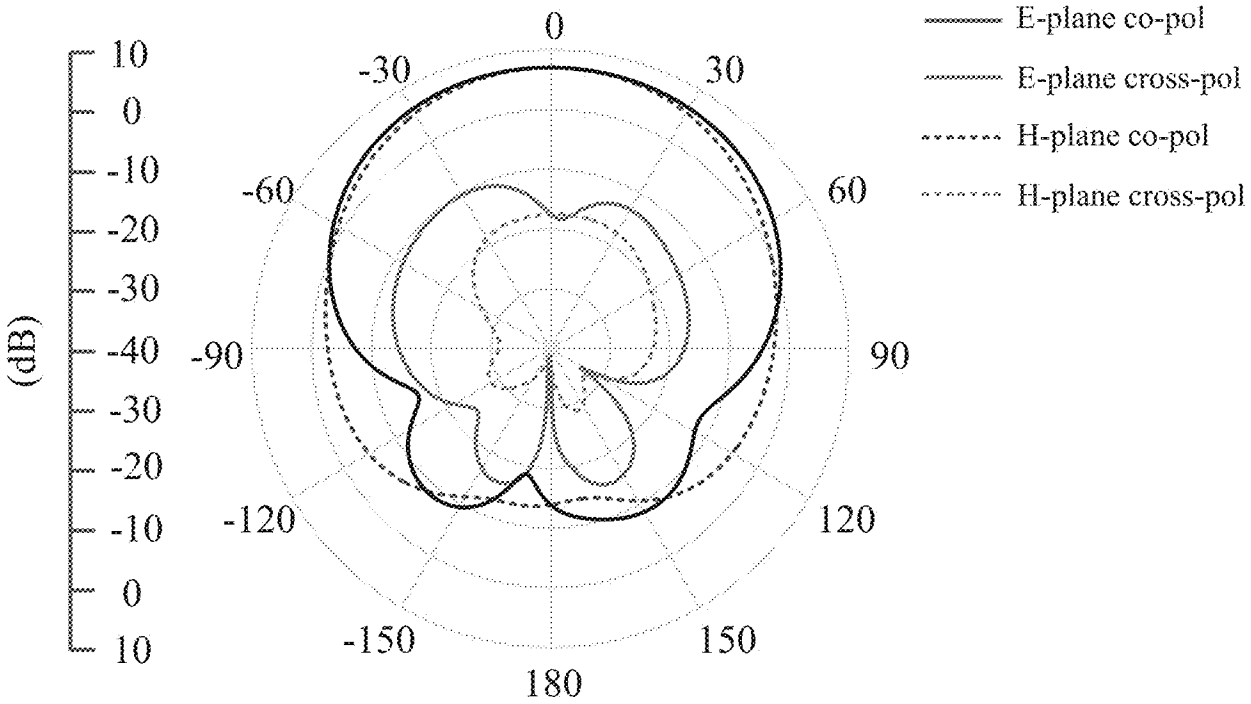
FIG. 6C is a simulated radiation pattern (x-polarization) of the wideband complementary antenna of FIG. 1 at 38 GHz.
Figure 7A:
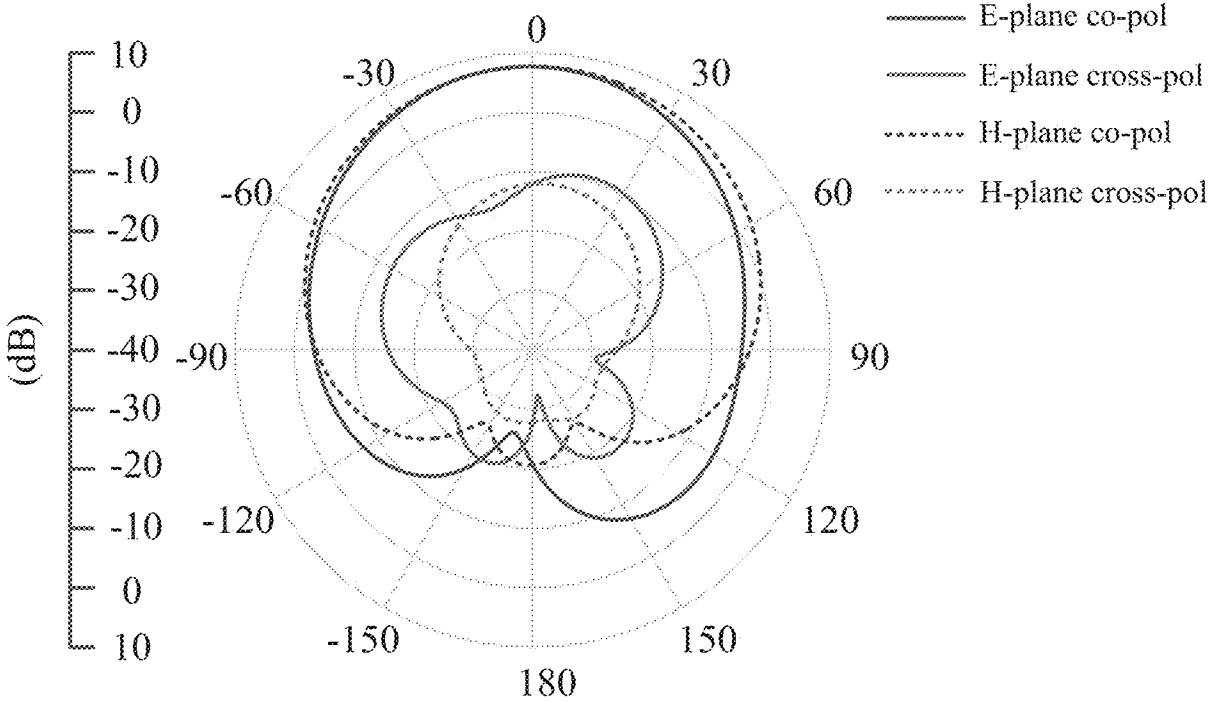
FIG. 7A is a simulated radiation pattern (y-polarization) of the wideband complementary antenna of FIG. 1 at 28 GHz.
Figure 7B:
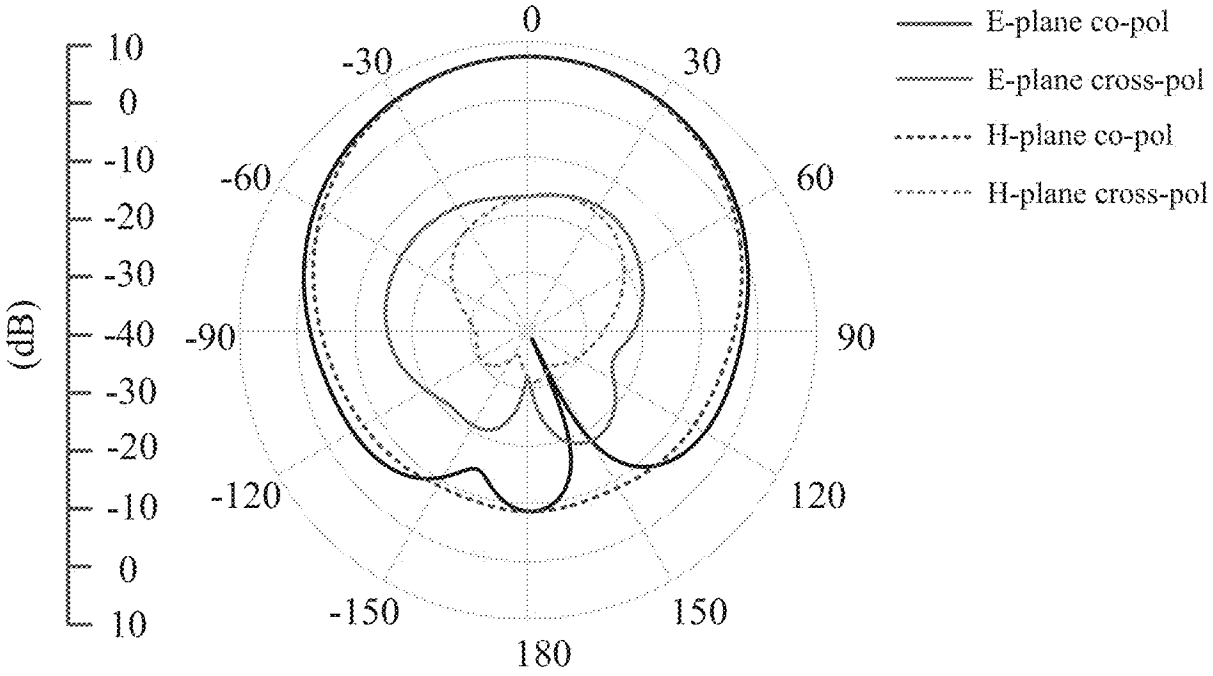
FIG. 7B is a simulated radiation pattern (y-polarization) of the wideband complementary antenna of FIG. 1 at 33 GHz.
Figure 7C:
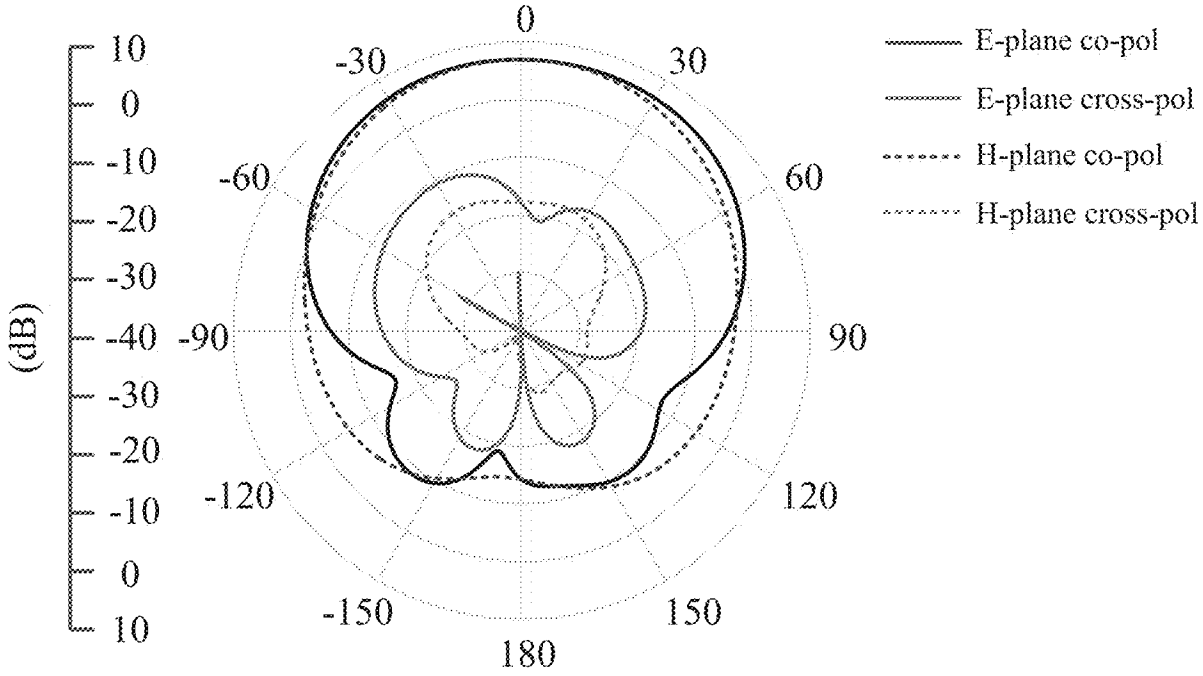
FIG. 7C is a simulated radiation pattern (y-polarization) of the wideband complementary antenna of FIG. 1 at 38 GHz.

FIGS. 6A to 6C show simulated radiation pattern (x-polarization) for the antenna embodiment of FIG. 1 at 28 GHz, 33 GHz, and 38 GHz respectively. FIGS. 7A to 7C show simulated radiation pattern (y-polarization) for the antenna embodiment of FIG. 1 at 28 GHz, 33 GHz, and 38 GHz respectively. It is observed from FIGS. 6A to 7C that the broadside radiation patterns in the E and H planes are almost identical. At the frequency of 33 GHz, the 3 dB beamwidth is 90° in H plane slightly higher than the 3dB beamwidth of 82° in E plane. Low cross polarization and low back radiation are also observed across the entire operational frequency.

Figure 8:
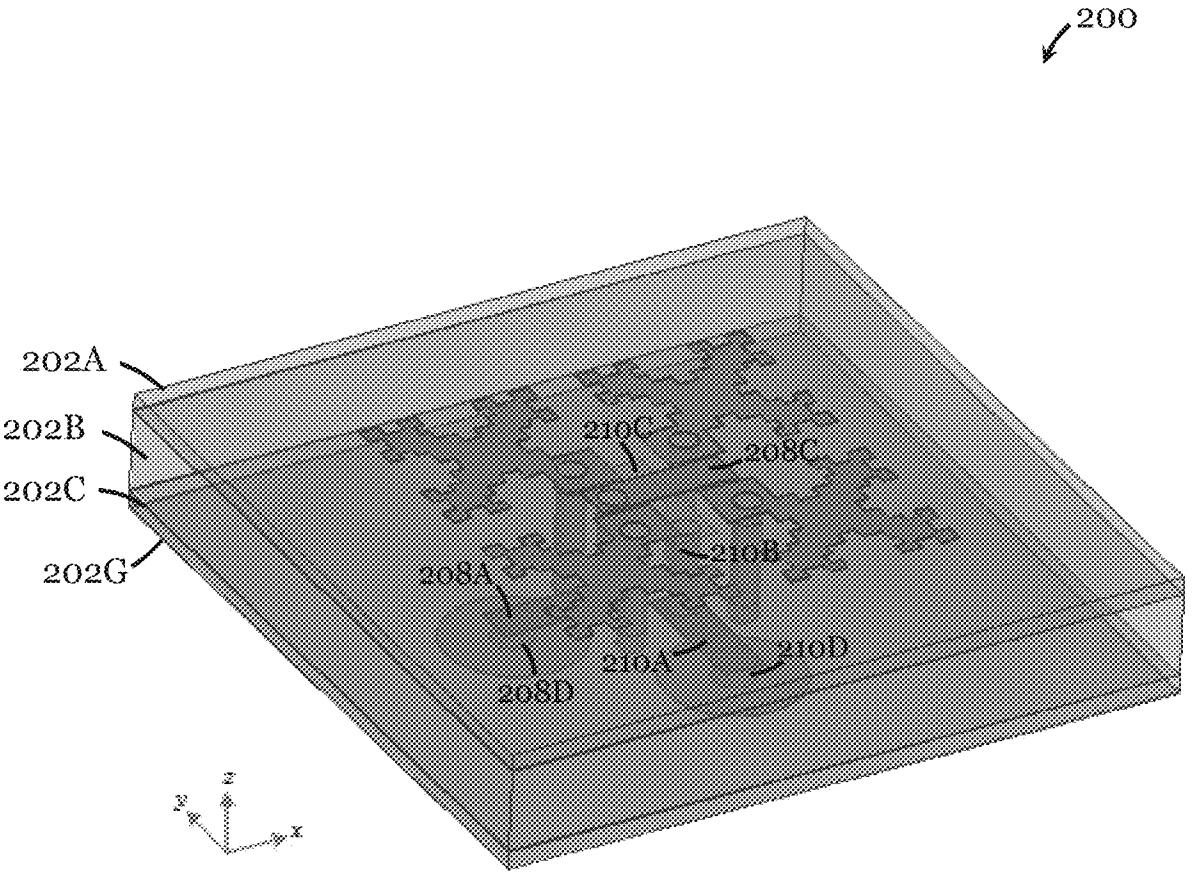
FIG. 8 is a wideband complementary antenna in one embodiment of the invention.

FIG. 8 illustrates an antenna 200 in another embodiment of the invention. The main difference between the antenna 200 in FIG. 8 and the antenna 100 in FIG. 1 is in the feeding structure. For simplicity, only the differences will be described here. In FIG. 8, the ground plane 202G is arranged on the lower side of the lower layer 202C of the substrate (e.g., may be part of the lower layer 202C).

Unlike the embodiment of FIG. 1, the first L-probe feed 208 in this embodiment includes a first vertical electrical conductor 208D extending through the lower layer 202C of the substrate, a planar microstrip line 208A arranged between the middle and lower layers 202B, 202C of the substrate, a second vertical electrical conductor 208B extending through the upper and middle layers 202A, 202B of the substrate, and a rectangular patch 208C arranged on an upper side of the upper layer 202A of the substrate. The first and second vertical electrical conductors 208B, 208D are offset from each other in plan view. The first vertical electrical conductor 208D has one end connected with the planar microstrip line 208A and another end arranged for coupling with a signal source. The microstrip line 208A extends horizontally, with one end connected with the first vertical electrical conductor 208D and another end connected with the second vertical electrical conductor 208B. The second vertical electrical conductor 208B has one end connected with the microstrip line 208A and another end connected with the patch 208C. The ground plane 202G includes a cut-out through which the first vertical electrical conductor 208D extends without contacting the ground plane 202G. The patch 208C extends horizontally, parallel to the upper plane of the upper layer 202A of the substrate. The patch 208C and the microstrip line 208A elongates along the same direction (x-direction). The patch 208C and the microstrip line 208A extend towards opposite sides with respect to the second vertical electrical conductor 208B in plan view. The vertical electrical conductors 208D, 208B can be a pin or a hole. The first L-probe 208 can be coupled to the first and second dipole portions.

The second L-probe feed 210 in this embodiment includes a first vertical electrical conductor 210D extending through the lower layer 202C of the substrate, a planar microstrip line 210A arranged between the middle and lower layers 202B, 202C of the substrate, a second vertical electrical conductor 210B extending through the middle layer, 202B of the substrate, and a rectangular patch 210C arranged on a lower side of the upper layer 202A of the substrate (or an upper side of the middle layer 202B of the substrate). The first and second vertical electrical conductors 210D, 210B are offset from each other in plan view. The first vertical electrical conductor 210D has one end connected with the planar microstrip line 210A and another end arranged for coupling with a signal source. The microstrip line 210A extends horizontally, with one end connected with the first vertical electrical conductor 210D and another end connected with the second vertical electrical conductor 210B. The second vertical electrical conductor 210B has one end connected with the microstrip line 210A and another end connected with the patch 210C. The ground plane 202G includes a cut-out through which the first vertical electrical conductor 210D extends without contacting the ground plane 202G. The patch 210C extends horizontally, parallel to the upper plane of the upper layer 202A of the substrate. The patch 210C and the microstrip line 210A elongates along the same direction (y-direction). The patch 210C and the microstrip line 210A extend towards opposite sides with respect to the second vertical electrical conductor 210B in plan view. The vertical electrical conductor 210B, 210D can be a pin or a hole. The microstrip line 210A extends horizontally and orthogonal to the microstrip line 208A of the first L-probe feed 208, without contacting the microstrip line 208A of the first L-probe feed 208. The microstrip line 210A has one end connected with the first vertical electrical conductor 210B and another end connected with the second vertical electrical conductor 210D. The second vertical electrical conductor 210B has one end connected with the microstrip line 210A and another end connected with the patch 210C. The ground plane 202G includes a cut-out through which the first vertical electrical conductor 210D extends without contacting the ground plane 202G. The patch 210C extends horizontally parallel to the lower plane of the upper layer 202A of the substrate, and orthogonal to the patch 208C of the first L-probe feed 208. The patch 210C and the microstrip line 210A of the second L-probe feed 210 elongates along the same direction (y-direction), orthogonal to the patch 208C and the microstrip line 208A of the first L-probe feed 208. The patch 210C and the microstrip line 210A extend towards opposite sides with respect to the vertical electrical conductor 210B in plan view. The vertical electrical conductors 210D, 210B can be a pin or a hole. The second L-probe 210 can be coupled to the third and fourth dipole portions.

Other structure of the antenna 200 of FIG. 8 is largely the same as the structure of the antenna 100 of FIG. 1. Like references are used for like features.

In the embodiment of FIG. 8, the four electrically conductive elements 206A, 206B, 206C and 206D, together with the portion of the ground plane 202G between them, and the first L-probe feed 208 (including 208A-208D), form a first shorted antenna. The first shorted antenna together with first electric dipole (provided by the first and second antenna sections 204A, 204B) and second electric dipole (provided by the third and fourth antenna sections 204C, 204D) complementary to the first shorted antenna form a complementary antenna that can provide a linear polarization (x-polarization). The four electrically conductive elements 206A, 206B, 206C and 206D, together with the portion of the ground plane 202G between them, and the second L-probe feed 210 (including 210A-210D), form a second shorted antenna. The second shorted antenna together with the third electric dipole (provided by the first and third antenna sections 204A, 204C) and fourth electric dipole (provided by the second and fourth antenna sections 204B, 204D) complementary to the second shorted antenna form a complementary antenna that can provide another linear polarization (y-polarization).

Figure 9C:
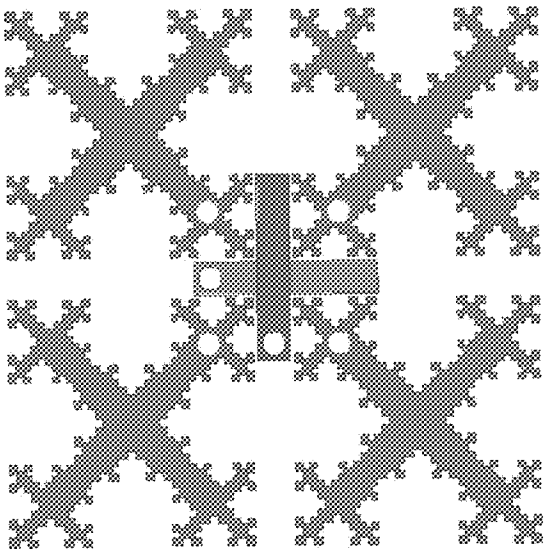
FIG. 9C is a schematic diagram of a Minkowski-based fractal antenna of third fractal order with four patch antenna sections in one embodiment of the invention (also showing the feeding patches)
Figure 9B:
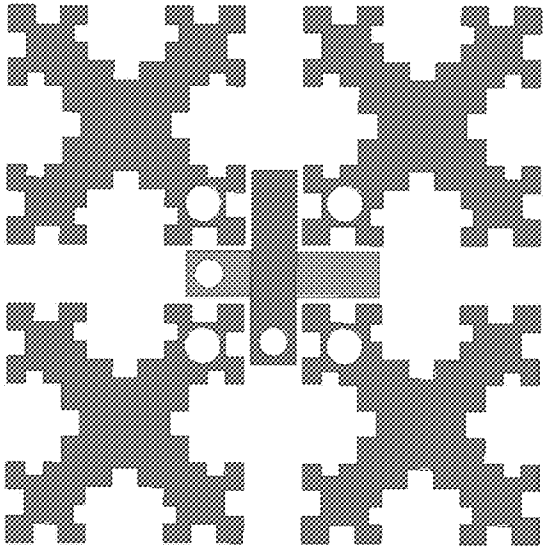
FIG. 9B is a schematic diagram of a Minkowski-based fractal antenna of second fractal order with four patch antenna sections in one embodiment of the invention (also showing the feeding patches)
Figure 9A:
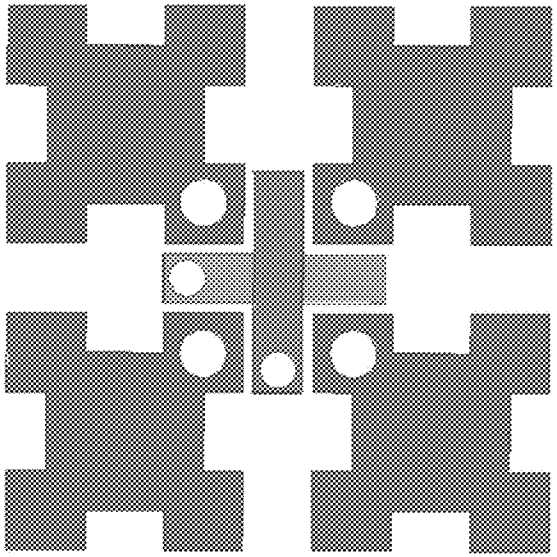
FIG. 9A is a schematic diagram of a Minkowski-based fractal antenna of first fractal order with four patch antenna sections in one embodiment of the invention (also showing the feeding patches)

FIGS. 9A to 9C show various Minkowski-based fractal antenna embodiments (these drawings also show the rectangular patches of the feeding structure). In FIG. 9A, the Minkowski-based fractal antenna is in the first order, with a fractal extent $\alpha$ of 0.7. In FIG. 9B, the Minkowski-based fractal antenna is in the second order, with a fractal extent $\alpha$ of 0.7. In FIG. 9C, the Minkowski-based fractal antenna is in the third order, with a fractal extent $\alpha$ of 0.7. All fractal antenna sections include via holes near the center of the antenna, like the embodiment of FIG. 1.

Figures 10A, 10B, 10C:
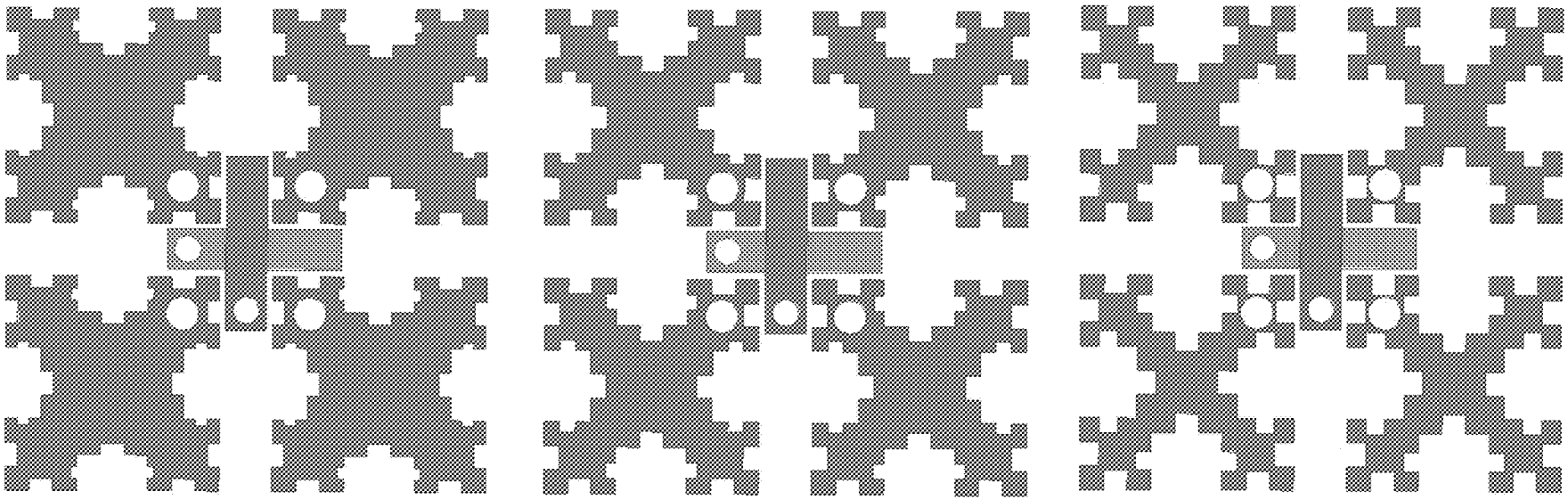
FIG. 10A is a schematic diagram of a Minkowski-based fractal antenna of second fractal order with four patch antenna sections and a fractal extent α of 0.5 in one embodiment of the invention (also showing the feeding patches)
FIG. 10B is a schematic diagram of a Minkowski-based fractal antenna of second fractal order with four patch antenna sections and a fractal extent α of 0.65 in one embodiment of the invention (also showing the feeding patches)
FIG. 10C is a schematic diagram of a Minkowski-based fractal antenna of second fractal order with four patch antenna sections and a fractal extent α of 0.8 in one embodiment of the invention (also showing the feeding patches)

FIGS. 10A to 10C show various Minkowski-based fractal antenna embodiments. In FIG. 10A, the Minkowski-based fractal antenna is in the second order, with a fractal extent $\alpha$ of 0.5. In FIG. 10B, the Minkowski-based fractal antenna is in the second order, with a fractal extent of 0.65. In FIG. 10C, the Minkowski-based fractal antenna is in the second order, with a fractal extent of 0.8. All fractal antenna sections include via holes near the center of the antenna, like the embodiment of FIG. 1.

Figure 11A:
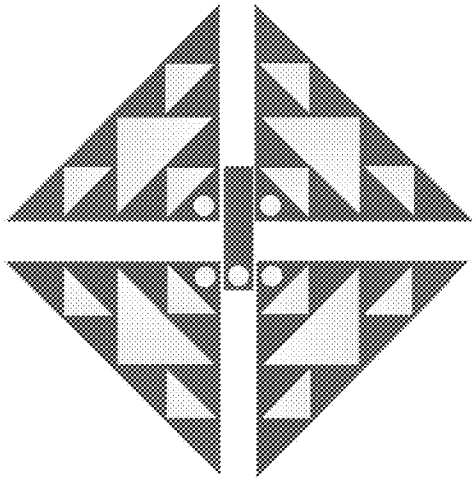
FIG. 11A is a schematic diagram of a Sierpinski-Gasket-based fractal antenna with four patch antenna sections in one embodiment of the invention (also showing the feeding patch)
Figure 11B:
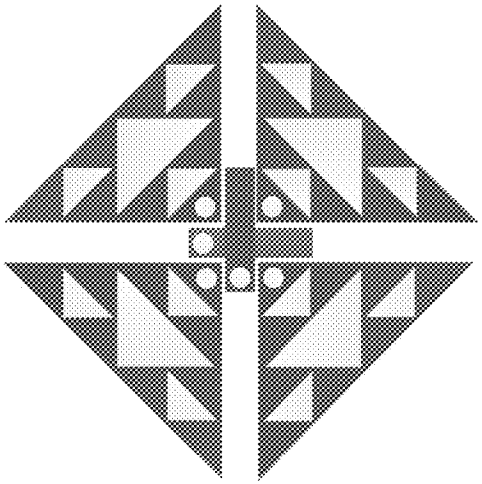
FIG. 11B is a schematic diagram of a Sierpinski-Gasket-based fractal antenna with four patch antenna sections in one embodiment of the invention (also showing the feeding patches)
Figure 11C:
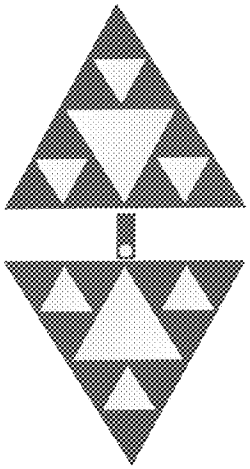
FIG. 11C is a schematic diagram of a Sierpinski-Gasket-based fractal antenna with two patch antenna sections in one embodiment of the invention (also showing the feeding patch)
Figure 11D:
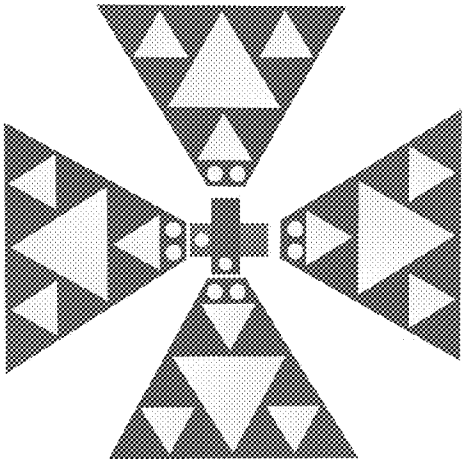
FIG. 11D is a schematic diagram of a Sierpinski-Gasket-based fractal antenna with four patch antenna sections in one embodiment of the invention (also showing the feeding patches)

FIGS. 11A to 11D show various Sierpinski-Gasket-based fractal antenna embodiments. In FIG. 11A, the Sierpinski-Gasket-based fractal antenna is of the second order, with four sections and providing one linear polarization (with only one feeding patch). In FIG. 11B, the Sierpinski-Gasket-based fractal antenna is of the second order, with four sections and providing two linear polarizations (with two feeding patches). In FIG. 11C, the Sierpinski-Gasket-based fractal antenna is of the second order, with two sections and providing one linear polarization (with only one patch). In FIG. 11D, the Sierpinski-Gasket-based fractal antenna is of the second order, with four sections and providing two linear polarizations (with two feeding patches). The fractal antenna sections in FIGS. 11A, 11B, and 11D include via holes near the center of the antenna, like the embodiment of FIG. 1.

Figure 12B:
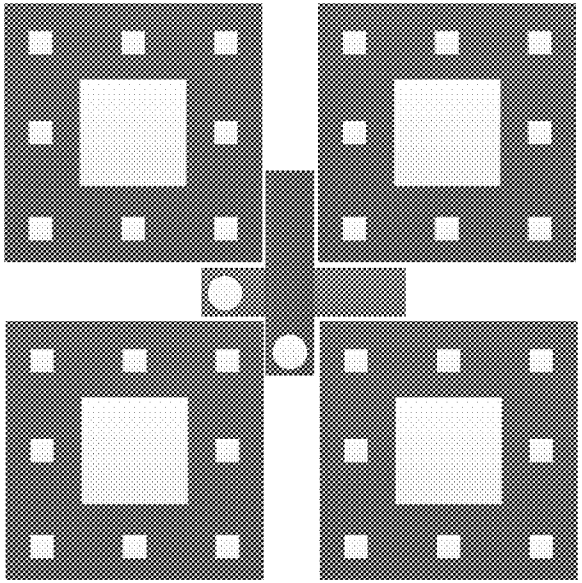
FIG. 12B is a schematic diagram of a Sierpinski-Carpet-based fractal antenna with four patch antenna sections in one embodiment of the invention (also showing the feeding patches)
Figure 12A:
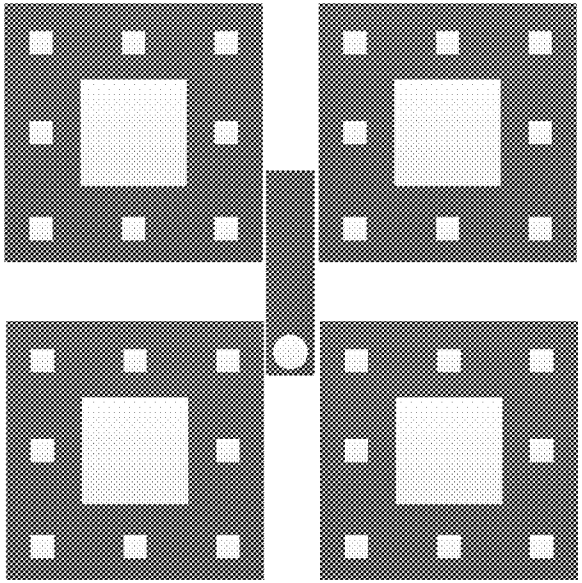
FIG. 12A is a schematic diagram of a Sierpinski-Carpet-based fractal antenna with four patch antenna sections in one embodiment of the invention (also showing the feeding patch)

FIGS. 12A and 12B show various Sierpinski-Carpet-based fractal antenna embodiments. In FIG. 12A, the Sierpinski-Carpet-based fractal antenna is of the second order, with four sections and providing one linear polarization (with only one feeding patch). In FIG. 12B, the Sierpinski-Carpet-based fractal antenna is of the second order, with four sections and providing two linear polarizations (with two feeding patches).

All antennas embodiments in FIGS. 9A to 12B can be excited in the same way as that in FIG. 1 or that of FIG. 8.

Figure 13:
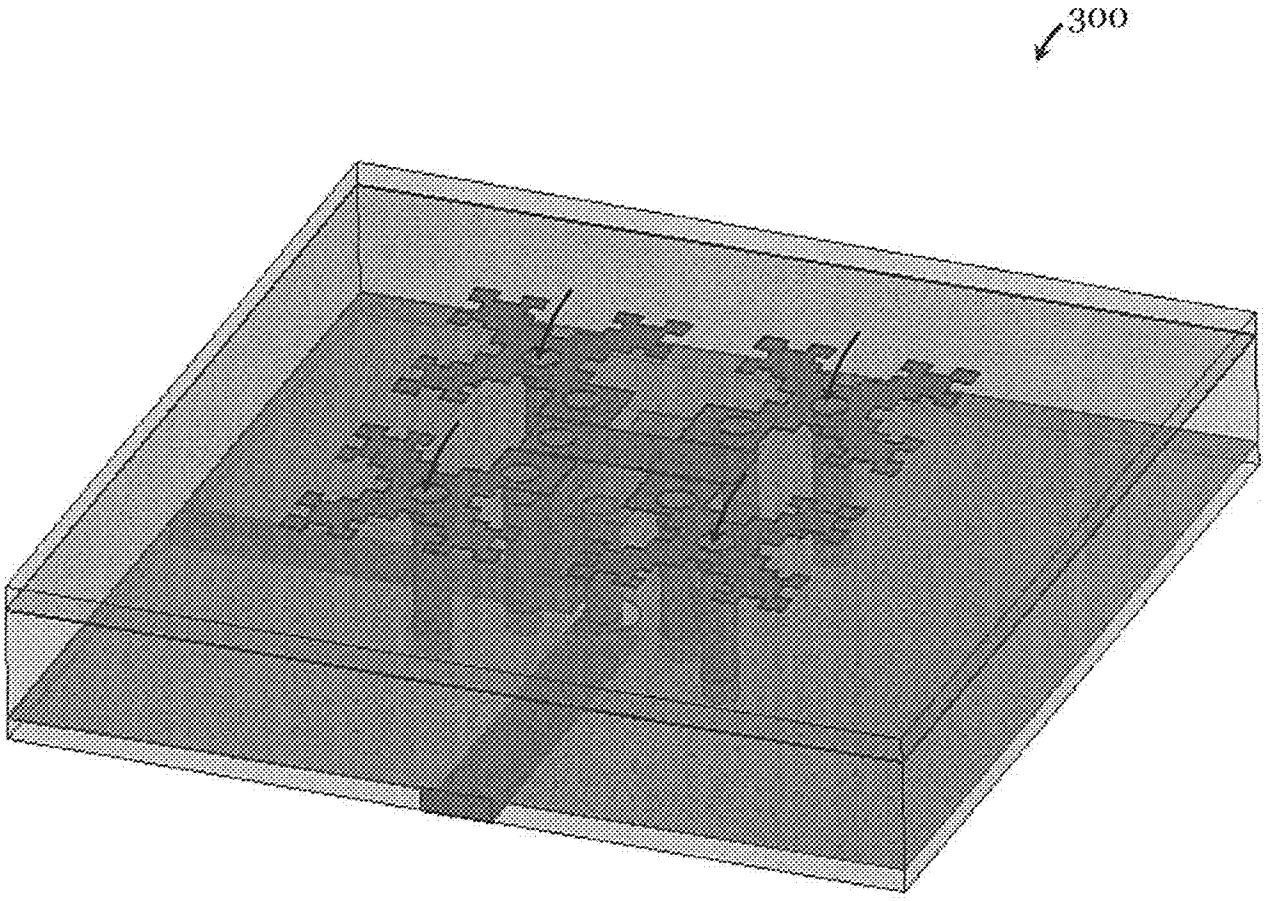
FIG. 13 is a wideband complementary antenna in one embodiment of the invention.

FIG. 13 illustrates an antenna 300 in another embodiment of the invention. The only difference between the antenna 300 in FIG. 13 and the antenna 100 in FIG. 1 is in the arrangement of additional via holes and associated electric conductors (See Arrows). In FIG. 13, each patch antenna sections include an additional via hole at its center part. Each additional via hole is further associated or connected with a respective vertical electric conductor that extends through all three layers of the substrate.

Figure 14:
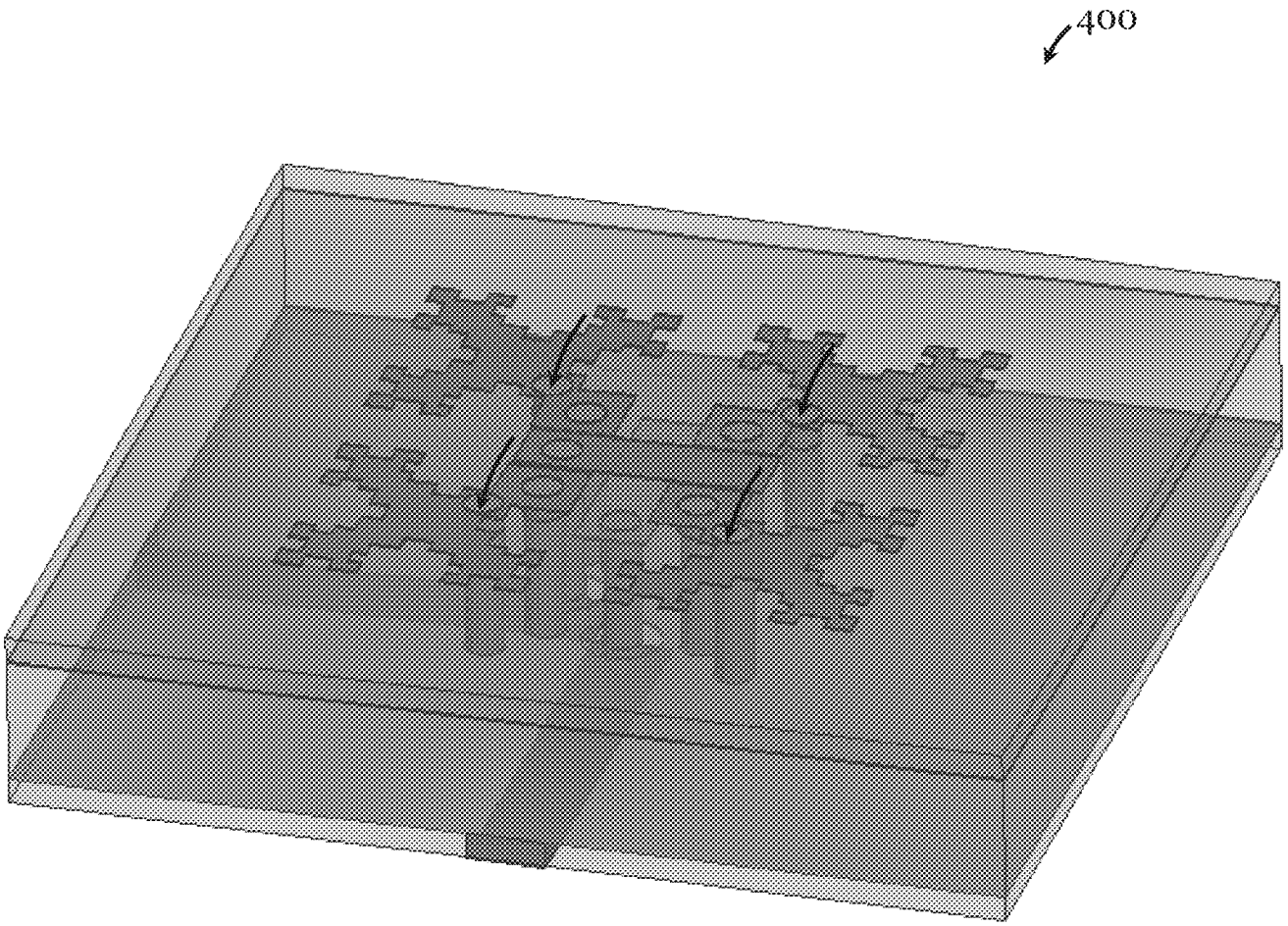
FIG. 14 is a wideband complementary antenna in one embodiment of the invention.

FIG. 14 illustrates an antenna 400 in another embodiment of the invention. The only difference between the antenna 400 in FIG. 14 and the antenna 100 in FIG. 1 is in the arrangement of additional via holes and associated electric conductors (See Arrows). In FIG. 14, each patch antenna sections include an additional via hole adjacent and outwardly (with respect to the center of the fractal antenna) of the first via hole. Each additional via hole is further associated or connected with a respective vertical electric conductor that extends through at least the upper and middle layers, and preferably all three layers of the substrate.

The wideband complementary antenna in the above embodiments can be used in, for example, millimeter-wave array antenna application. Advantageously, the antennas in the above embodiments are operationally efficient and can be made small and compact. Such antennas can be easily incorporated into small-sized communication systems and devices, allowing the systems and devices to accommodate more antennas per unit area, or enabling them to achieve lower mutual coupling with the same number of elements. The antennas in the above embodiments are also easy to make and economical to manufacture.

Although the antenna embodiments described above with reference to the drawings are referred to as "wideband complementary antenna", the structure and function of the antennas in the above embodiments can be applied to other types to antennas such as millimeter-wave antennas, microwave antennas.

The antennas of the invention can be applied in millimeter-wave communication systems, microwave communication systems, etc. The antennas of the invention can be used in planar antenna arrays arranged to operate at millimeter-wave frequencies. For example, the antennas of the invention can be implemented in an antenna system that includes multiple planar antenna arrays integrated with a chip acting as the feeding network. The antenna of the invention can be modified and arranged to generate circularly polarized, linearly polarized, or dual polarized radiation with significantly miniaturized aperture, without compromising too much impedance bandwidth and other radiation characteristics of the antenna.

It will be appreciated by persons skilled in the art that numerous variations and/or modifications may be made to the invention as shown in the specific embodiments without departing from the spirit or scope of the invention as broadly described. For example, the antenna in some embodiments of the invention can have more than or less than 3 layers. The antenna in some embodiments can take different size. The size of the fractal antenna formed by the complementary patch antenna sections is preferably in the order of cm, preferably less than 5 cm×5 cm. The number of complementary patch antenna sections can be more than or less than 4. The complementary patch antenna sections preferably exist in pairs. The fractal order of the complementary patch antenna sections can be different or the same. Higher fractal order is preferred. Cut-outs and via holes are also preferred in the complementary patch antenna sections. The number of cut-outs and via holes is not limited to specific number. The more cut-outs and via holes, the less material is used and the antenna could be made small and compact. The feed structure of the antenna can be L-shaped feed, feed probe, etc. The fractal antenna preferably has at least one axis of symmetry.

The described embodiments of the invention should therefore be considered in all respects as illustrative, not restrictive.

The invention claimed is:

1. An antenna, comprising:

a substrate with a ground plane;

a fractal antenna arranged on the substrate, the fractal antenna including a first pair of patch antenna sections that are spaced apart;

a first pair of electric conductive elements, spaced apart, extending in the substrate, and arranged generally orthogonal to the first pair of patch antenna sections, each of the first pair of electric conductive elements being operably connected with a respective one of the first pair of patch antenna sections; and a first feeding mechanism operably connected with the first pair of patch antenna sections for feeding the first pair of patch antenna sections.

2. The antenna of claim 1, wherein the first pair of patch antenna sections each includes a via hole at a corner or side; and wherein each of the first pair of electric conductive elements is operably connected with the via hole of the respective one of the first pair of patch antenna sections.

3. The antenna of claim 2, wherein the first pair of electric conductive elements are pins.

4. The antenna of claim 2, wherein the fractal antenna further includes a second pair of patch antenna sections that are spaced apart, and the antenna further includes a second pair of electric conductive elements that are spaced apart, extending in the substrate, and arranged generally orthogonal to the second pair of patch antenna sections, wherein each of the second pair of electric conductive elements is operably connected with a respective one of the second pair of patch antenna sections, and wherein the first feeding mechanism is further operably connected with the second pair of patch antenna sections for feeding the second pair of patch antenna sections.

5. The antenna of claim 4, wherein the first and second pair of patch antenna sections are equally angularly spaced apart with respect to a center of the fractal antenna.

6. The antenna of claim 4, wherein the second pair of patch antenna sections each includes a via hole at a corner or side; and wherein each of the second pair of electric conductive elements is operably connected with the via hole of the respective one of the second pair of patch antenna sections.

7. The antenna of claim 4, wherein the second pair of electric conductive elements are pins.

8. The antenna of claim 4, wherein the second pair of patch antenna sections both have:

a Minkowski-based antenna structure;

a Sierpinski Gasket-based antenna structure; or a Sierpinski Carpet-based antenna structure.

9. The antenna of claim 8, wherein the second pair of patch antenna sections have the same fractal orders, the fractal orders being second or higher fractal orders.

10. The antenna of claim 4, wherein the first and second pairs of patch antenna sections have the same fractal orders, the fractal orders being second or higher fractal orders.

11. The antenna of claim 4, further comprising a second feeding mechanism operably connected with the first and second pairs of patch antenna sections for feeding the first and second pairs of patch antenna sections.

12. The antenna of claim 11, wherein the substrate comprises a first upper layer, a second middle layer, and a third lower layer; and the fractal antenna is arranged on the first upper layer.

13. The antenna of claim 12, wherein the ground plane is arranged between the second middle layer and the third lower layer.

14. The antenna of claim 13, wherein the first feeding mechanism includes an L-probe feed.

15. The antenna of claim 14, wherein the L-probe feed of the first feeding mechanism includes:

a first feeding patch arranged on the first upper layer in between the first pair of patch antenna sections and in between the second pair of patch antenna sections in plan view;

a first microstrip line arranged in or below the third lower layer; and a first electrical conductor extending through the substrate and connecting with the first feeding element and the first microstrip line.

16. The antenna of claim 15, wherein the first electrical conductor is a vertical pin or hole; and wherein the ground plane has a cut-out such that the first electrical conductor extends through the ground plane without contacting the ground plane.

17. The antenna of claim 15, wherein the first feeding patch and the first microstrip line are arranged parallel to each other.

18. The antenna of claim 15, wherein the second feeding mechanism includes an L-probe feed.

19. The antenna of claim 18, wherein the L-probe feed of the second feeding mechanism includes:

a second feeding patch arranged between the first upper layer and the second middle layer, and in between the first pair of patch antenna sections and in between the second pair of patch antenna sections in plan view;

a second microstrip line arranged in or below the third lower layer; and a second electrical conductor extending through the second middle layer and the third lower layer of the substrate and connecting with the second feeding patch and the second microstrip line.

20. The antenna of claim 19, wherein the second electrical conductor is a vertical pin or hole; and wherein the ground plane has a cut-out such that the second electrical conductor extends through the ground plane without contacting the ground plane.

21. The antenna of claim 19, wherein the second feeding patch and the second microstrip line are arranged parallel to each other.

22. The antenna of claim 19, wherein the second feeding patch and the first feeding patch are arranged orthogonal to each other in plan view.

23. The antenna of claim 12, wherein the ground plane is arranged on a lower side of the third lower layer.

24. The antenna of claim 23, wherein the first feeding mechanism includes an L-probe feed.

25. The antenna of claim 24, wherein the L-probe feed of the first feeding mechanism includes:

a first feeding patch arranged on the first upper layer in between the first pair of patch antenna sections and in between the second pair of patch antenna sections in plan view;

a first microstrip line arranged in or below the second middle layer;

a first electrical conductor section extending through the first upper layer and the second middle layer to connect the first feeding patch and the first microstrip line; and a second electrical conductor section connecting with the first microstrip line and extending through the third lower layer and the ground plane.

26. The antenna of claim 25, wherein the first electrical conductor section and the second electrical conductor section are vertical pins or holes; and wherein the ground plane has a cut-out such that the second electrical conductor section extends through the ground plane without contacting the ground plane.

27. The antenna of claim 26, wherein the first electrical conductor section and the second electrical conductor section are offset in plan view.

28. The antenna of claim 25, wherein the first feeding patch and the first microstrip line are arranged parallel to each other.

29. The antenna of claim 25, wherein the second feeding mechanism includes an L-probe feed.

30. The antenna of claim 29, wherein the L-probe feed of the second feeding mechanism includes:

a second feeding patch arranged between the first upper layer and the second middle layer, and in between the first pair of patch antenna sections and in between the second pair of patch antenna sections in plan view;

a second microstrip line arranged in or below the second middle layer;

a third electrical conductor section extending at least through the second middle layer to connect the second feeding patch and the second microstrip line; and a fourth electrical conductor section connecting with the second microstrip line and extending through the third lower layer and the ground plane.

31. The antenna of claim 30, wherein the third electrical conductor section and the fourth electrical conductor section are vertical pins or holes; and wherein the ground plane has a cut-out such that the fourth electrical conductor section extends through the ground plane without contacting the ground plane.

32. The antenna of claim 30, wherein the third electrical conductor section and the fourth electrical conductor section are offset in plan view.

33. The antenna of claim 30, wherein the second feeding patch and the second microstrip line are arranged parallel to each other.

34. The antenna of claim 30, wherein the first feeding patch and the second feeding patch are arranged orthogonal to each other in plan view.

35. The antenna of claim 1, wherein the first pair of patch antenna sections are of the same size and same shape.

36. The antenna of claim 1, wherein the first pair of patch antenna sections both have:

a Minkowski-based antenna structure;

a Sierpinski Gasket-based antenna structure; or a Sierpinski Carpet-based antenna structure.

37. The antenna of claim 36, wherein the first pair of patch antenna sections has the same fractal orders, the fractal orders being second or higher fractal orders.

38. The antenna of claim 1, wherein the fractal antenna has a symmetric configuration.

39. An antenna array comprising the antenna of claim 1.

40. An electrical communication device comprising the antenna of claim 1.

* * * * *